US006439423B1

(12) United States Patent
Suzuki

(10) Patent No.: US 6,439,423 B1
(45) Date of Patent: Aug. 27, 2002

(54) VENDING MACHINE HAVING A COMMODITY DISCHARGE APPARATUS EXCELLENT IN THEFTPROOFNESS

(75) Inventor: Kazuhiko Suzuki, Takasaki (JP)

(73) Assignee: Sanden Corp. (JP)

( * ) Notice: Subject to any disclaimer, the term of this patent is extended or adjusted under 35 U.S.C. 154(b) by 14 days.

(21) Appl. No.: 09/654,574

(22) Filed: Sep. 1, 2000

(30) Foreign Application Priority Data

Sep. 2, 1999 (JP) ..... 11-248147

(51) Int. Cl.[7] ..... G07F 11/00
(52) U.S. Cl. ..... 221/81; 221/85; 221/89
(58) Field of Search ..... 221/76, 79, 81, 221/82, 84, 85, 89, 90; 198/678.1, 836.1

(56) References Cited

U.S. PATENT DOCUMENTS

| | | | | |
|---|---|---|---|---|
| 2,796,181 A | | 6/1957 | Smith | |
| 3,163,276 A | | 12/1964 | McLaughlin | |
| 3,716,165 A | * | 2/1973 | Patrick | |
| 3,720,350 A | * | 3/1973 | Patrick | 221/85 X |
| 3,734,345 A | | 5/1973 | Garner | |
| 3,756,455 A | * | 9/1973 | Patrick | 221/85 |
| 3,757,993 A | * | 9/1973 | Bruckner et al. | 221/85 X |
| 3,765,566 A | | 10/1973 | Dasher | |
| 3,780,909 A | * | 12/1973 | Callahan et al. | 221/85 |
| 3,814,282 A | | 6/1974 | Stoltz et al. | |

FOREIGN PATENT DOCUMENTS

| | | |
|---|---|---|
| GB | 1 297 641 | 11/1972 |
| JP | 49-150300 | 12/1974 |

* cited by examiner

*Primary Examiner*—David H. Bollinger
(74) *Attorney, Agent, or Firm*—Banner & Witcoff, Ltd.

(57) ABSTRACT

In a commodity discharge apparatus for a vending machine, an endless chain (2) extends on a vertical plane to form an endless loop and is engaged with a first and a second sprocket (1*a*, 1*b*) which are spaced from each other in a horizontal direction. The endless chain is adapted to circulate through the first and the second sprockets and through a lower and an upper traveling path each extending between the first and the second sprockets. A hook (3) is unrotatably attached to a part of the endless chain and is for hooking a commodity (100) only when the part is placed at the lower traveling path. In addition, a fall preventing member (7) is provided to extend in parallel to the lower traveling path beside the hook for preventing a fall of the commodity from the hook.

16 Claims, 6 Drawing Sheets

VENDING MACHINE HAVING A COMMODITY DISCHARGE APPARATUS EXCELLENT IN THEFTPROOFNESS

BACKGROUND OF THE INVENTION

The present invention relates to a commodity discharge apparatus for a vending machine.

A conventional commodity discharge apparatus for a vending machine is disclosed in, for example, Japanese Unexamined Utility Model Publication (JP-U) No. S49-150300. The conventional commodity discharge apparatus comprises an endless chain supported on a pair of sprockets to extend therebetween in a horizontal direction, and a plurality of hooks unrotatably attached to a plurality of pins of the endless chain, respectively, and arranged at a predetermined interval from each other. Commodities or goods are hooked to the hooks and carried along the endless chain towards a predetermined position by movement of the endless chain. On arriving at the predetermined position, each of the commodities is fallen from each of the hooks in the manner known in the art.

With this structure, the commodities can easily be released from the hooks before arrival at the predetermined position as well known in the art. Accordingly, the conventional commodity discharge apparatus has a risk that the commodities may be stolen in the manner which will be described below. Specifically, a stealer can rock a whole of the vending machine comprising the above-mentioned commodity discharge apparatus so that one or ones of the commodities are released from respective hooks to fall down towards a commodity outlet or discharge port. Then, the stealer can take out the goods from the commodity outlet port.

SUMMARY OF THE INVENTION

It is therefore an object of the present invention to provide a commodity discharge apparatus for a vending machine, which comprises an endless chain supported on a pair of front and rear sprockets to extend therebetween in a horizontal direction, a plurality of hooks unrotatably attached to a plurality of pins of the endless chain, and arranged at a predetermined interval from each other, and which is excellent in theftproofness.

Other objects of the present invention will become clear as the description proceeds.

A commodity discharge apparatus to which the present invention is applicable is for a vending machine. The commodity discharge apparatus comprises first and second sprockets spaced from each other in a horizontal direction and an endless chain engaged with the first and the second sprockets and extending on a vertical plane to form an endless loop. The endless chain is adapted to circulate through the first and the second sprockets and through a lower and an upper traveling path each extending between the first and the second sprockets. The commodity discharge apparatus further comprises a hook unrotatably attached to a part of the endless chain for hooking a commodity only when the part is placed at the lower traveling path and a fall preventing member extending in parallel to the lower traveling path beside the hook for preventing a fall of the commodity from the hook.

DESCRIPTION OF THE PREFERRED EMBODIMENT

Figure 1:
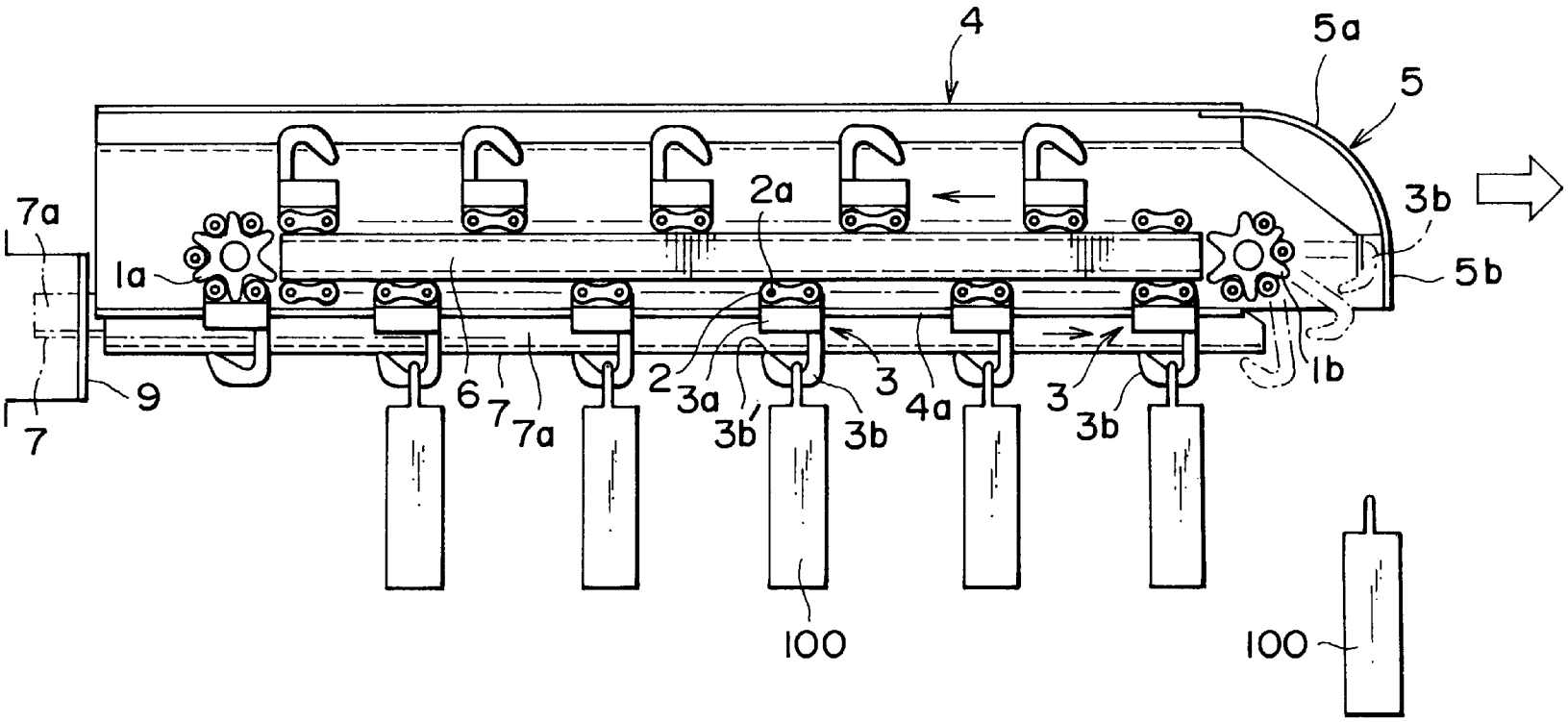
FIG. 1 is a side view of a commodity discharge apparatus according to an embodiment of the present invention in a state that one of side walls of a casing is removed.
Figure 2:
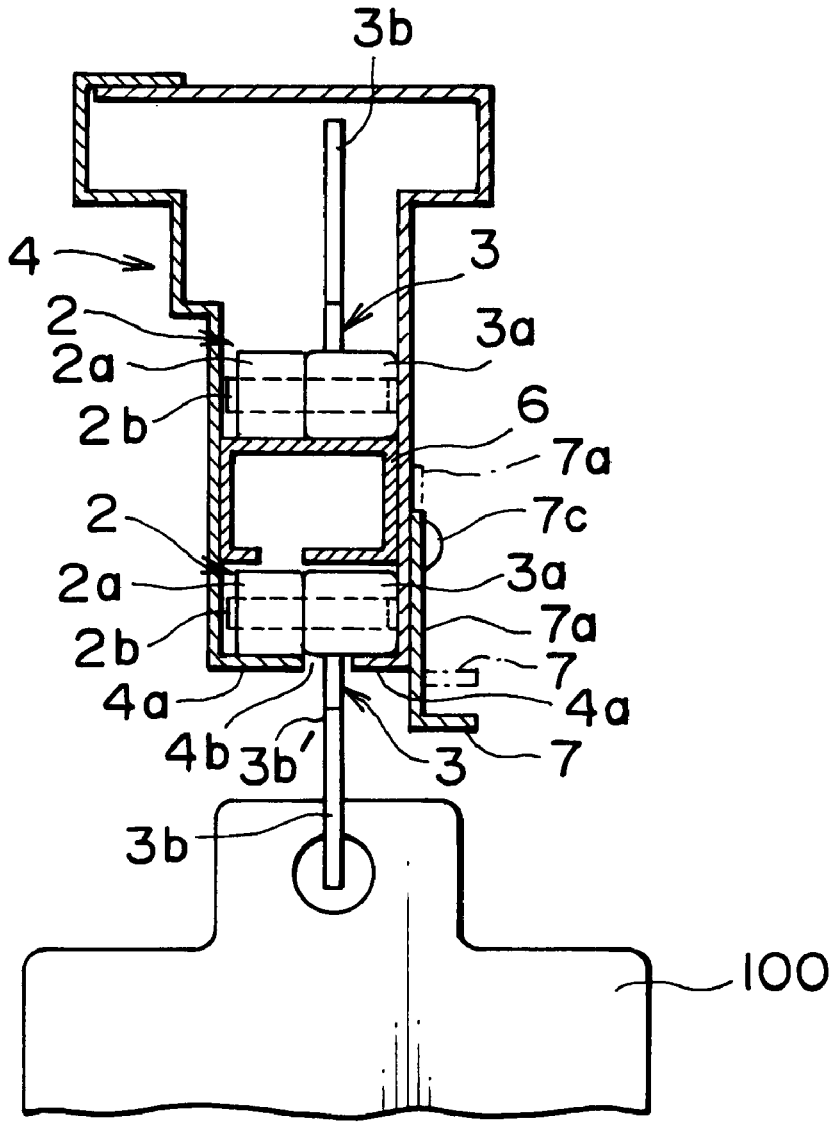
FIG. 2 is a sectional view of the commodity discharge apparatus illustrated in FIG. 1.

Referring to FIGS. 1 and 2, description will be made about a commodity discharge apparatus according to an embodiment of the present invention.

The commodity discharge apparatus comprises a first or rear sprocket 1*a*, a second or front sprocket 1*b* spaced from the rear sprocket 1*a* in a horizontal direction, and an endless chain 2 supported on the rear and the front sprockets 1*a* and 1*b* to extend therebetween on a vertical plane. The rear sprocket 1*a* is connected to a motor (not shown) having an encoder for driving the rotation of the rear sprocket 1*a*. The endless chain 2 travels along upper and lower traveling paths to circulate around the rear and the front sprockets 1*a* and 1*b*. More particularly, the endless chain 2 adapted to circulate through the rear and the front sprockets 1*a* and 1*b* and through a lower and an upper traveling path each extending between the rear and the front sprockets 1*a* and 1*b*.

In the description, a part of the endless chain 2 traveling along the upper traveling path may be referred to as an upper traveling portion. Likewise, the other part traveling along the lower traveling path may be referred to as a lower traveling portion. Specifically, the lower traveling portion of the endless chain 2 travels from the rear sprocket 1*a* toward the front sprocket 1*b* in a forward direction while the upper traveling portion travels from the front sprocket 1*b* toward the rear sprocket 1*a* in a rearward direction.

The endless chain 2 carries a plurality of commodity suspension hooks 3 which are attached to the endless chain 2 at a predetermined interval from one another for hooking commodities or goods only in the lower traveling portion of the endless chain 2. The endless chain 2 is accommodated in a cylindrical casing 4 having a generally rectangular section. The casing 4 has a bottom wall 4*a* extending generally in parallel to the endless chain 2 at a position immediately below the endless chain 2. The bottom wall 4*a* has a gap 4*b* extending in a longitudinal direction. The lower traveling portion of the endless chain 2 and the commodity suspension hook 3 in the suspended position are supported by the bottom wall 4*a* of the casing 4 in the vertical direction. The hook portion 3*b* of the commodity suspension hook 3 in the suspended position extends through the gap 4*b* to a position outside and below the casing 4.

As seen from the figure, the commodity suspension hooks 3 can take a suspended position in which they are suspended from the lower traveling portion of the endless chain 2 and a standing position in which they stand up from the upper traveling portion of the endless chain 2.

The casing 4 has a front end in the vicinity of the front sprocket 1*b*. The front end is closed by a cover 5 having a curved top wall 5*a* and a side wall 5*b* having a generally U-shaped section.

The casing 4 is provided with a guide rail 6 having a generally U-shaped section and arranged within the casing 4. The guide rail 6 extends generally in parallel to the endless chain 2. The upper traveling portion of the endless chain 2 and the commodity suspension hook 3 in the standing position are supported by the guide rail 6 in the vertical direction. The hook portion 3*b* of the commodity suspension hook 3 in the standing position is accommodated within the casing 4.

The commodity discharge apparatus further comprises a fall preventing plate 7 for preventing commodities or goods undesiredly falling off from the commodity suspension hooks 3. The fall preventing plate 7 extends in parallel to the endless chain 2 on a lateral side of the hook portions 3*b* of the commodity suspension hooks 3 and at a level substantially equal to that of the free ends 3*b*' of the hook portions 3*b* of the commodity suspension hooks 3 in the suspended position. The fall preventing plate 7 extends over a substantially full length of the endless chain 2. The fall preventing plate 7 extends to its rear end in the vicinity of a rear end of the casing 4. The fall preventing plate 7 has a fitting portion 7*a* integrally formed therewith and is attached to one of side walls of the casing 4 via the fitting portion 7*a*.

Figure 3:
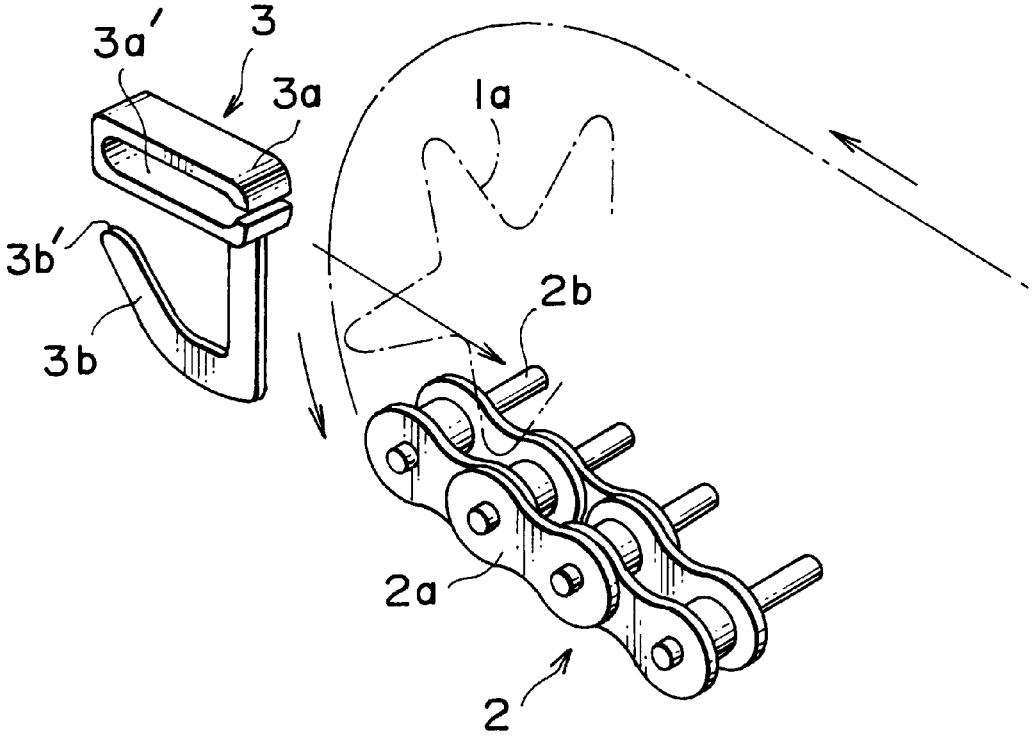
FIG. 3 is a perspective view showing the relation between an endless chain and a hook which are included in the commodity discharge apparatus of FIG. 1.

Referring to FIG. 3 together with FIGS. 1 and 2, the description will be directed to the endless chain 2 and the commodity suspension hooks 3. The endless chain 2 is generally called a roller chain and comprises a plurality of roller links 2*a* and a plurality of coupling pins 2*b* connecting the roller links 2*a* to each other to form an endless loop. Each of the coupling pins 2*b* protrudes on one side of the endless chain 2 or the roller links 2 in the horizontal direction.

Each of the commodity suspension hooks 3 comprises a coupling portion 3*a* and a hook portion 3*b* integrally formed with the coupling portion 3*a*. The coupling portion 3*a* is provided with a coupling hole 3*a'* of a generally elliptical shape. The coupling portion 3*a* of each commodity suspension hook 3 is tightly fitted over two adjacent ones of the coupling pins 2*b* of the endless chain 2 when the coupling pins 2*b* are inserted into the coupling hole 3*a*'. Thus, the commodity suspension hook 3 is attached to the endless chain 2 to be unrotatable around the coupling pins 2*b*. In the vicinity of the rear sprocket 1*a*, each of the commodity suspension hooks 3 is attached to the two coupling pins 2*b* of the lower traveling portion of the endless chain 2 in such a manner that a free end 3*b*' of the hook portion 3*b* is faced rearward. The hook portion 3*b* is so sharply bent that the free end 3*b*' of the hook portion 3*b* is closely adjacent to the coupling portion 3*a*.

Figure 4:
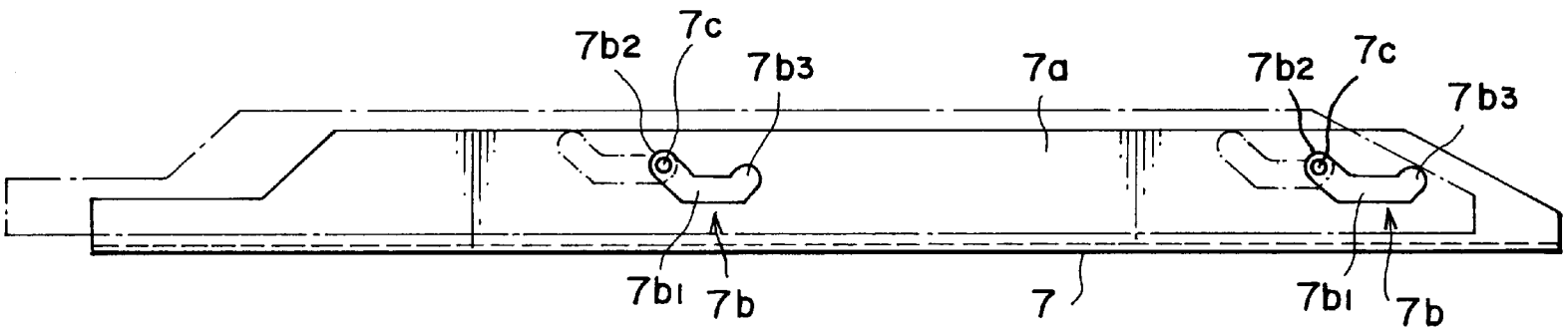
FIG. 4 is a side view of a fall preventing member included in the commodity discharge apparatus of FIG. 1.

Referring to FIG. 4 together with FIGS. 1 and 2, the description will be directed to the fall preventing plate 7. The fitting portion 7*a* of the fall preventing plate 7 has a pair of elongated holes 7*b* with a space left therebetween in the horizontal direction. Each of the elongated holes 7*b* has an intermediate portion 7*b*1 extending in the horizontal direction, an operation-mode locking portion 7*b*2 extending from a rear end of the intermediate portion 7*b*1 obliquely up rearward, and a retraction-mode locking portion 7*b*3 extending from a front end of the intermediate portion 7*b*1 obliquely up frontward. The operation-mode locking portion 7*b*2 has an upper end located above an upper end of the retraction-mode locking portion 7*b*3. The fall preventing plate 7 is attached to the one side wall of the casing 4 with the elongated holes 7*b* of the fitting portion 7*a* engaged with stepped screws 7*c* screwed into the one side wall of the casing 4.

When the commodity discharge apparatus is put into operation, the operation-mode locking portion 7*b*2 of the elongated hole 7*b* is engaged with the stepped screw 7*c* and, as illustrated by solid lines in FIGS. 1, 2, and 4, the fall preventing plate 7 is located at an operating position which is a lower and forward position. In this event, the fall preventing plate 7 extends in parallel to the endless chain 2 at the level substantially equal to that of the free ends 3*b*' of the hook portions 3*b* of the commodity suspension hooks 3 in the suspended position.

Figure 5:
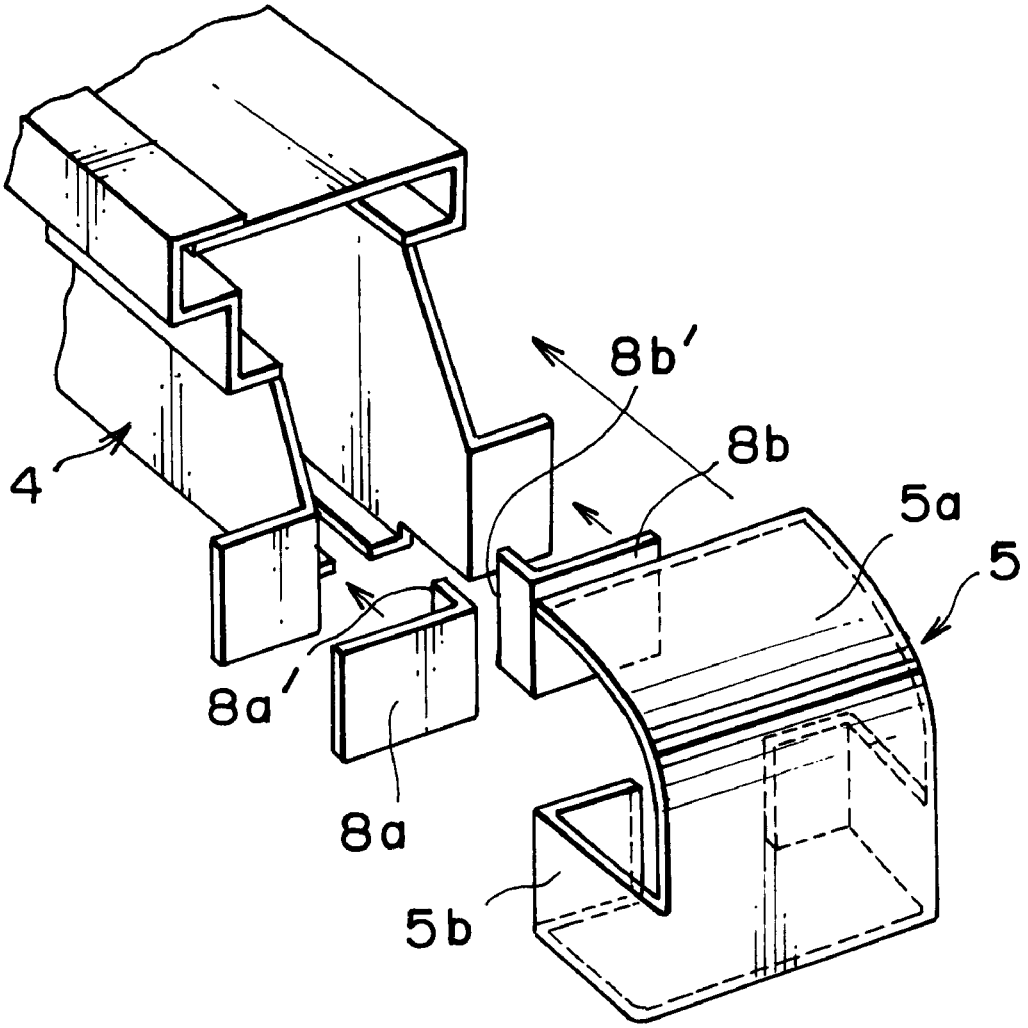
FIG. 5 is a perspective view of the relation between a cover and a release promoting member which are included in the commodity discharge apparatus of FIG. 1.

Upon charging the commodities, the retraction-mode locking portion 7*b*3 of each of the elongated holes 7*b* is engaged with the stepped screw 7*c* and, as illustrated by dot-and-dash lines in FIGS. 1, 3, and 5, the fall preventing plate 7 is located at a retracted position which is an upper rearward position. In this event, the fall preventing plate 7 extends in parallel to the endless chain 2 at a level above the free ends 3*b*' of the hook portions 3*b* of the commodity suspension hooks 3 in the suspended position.

Figure 6:
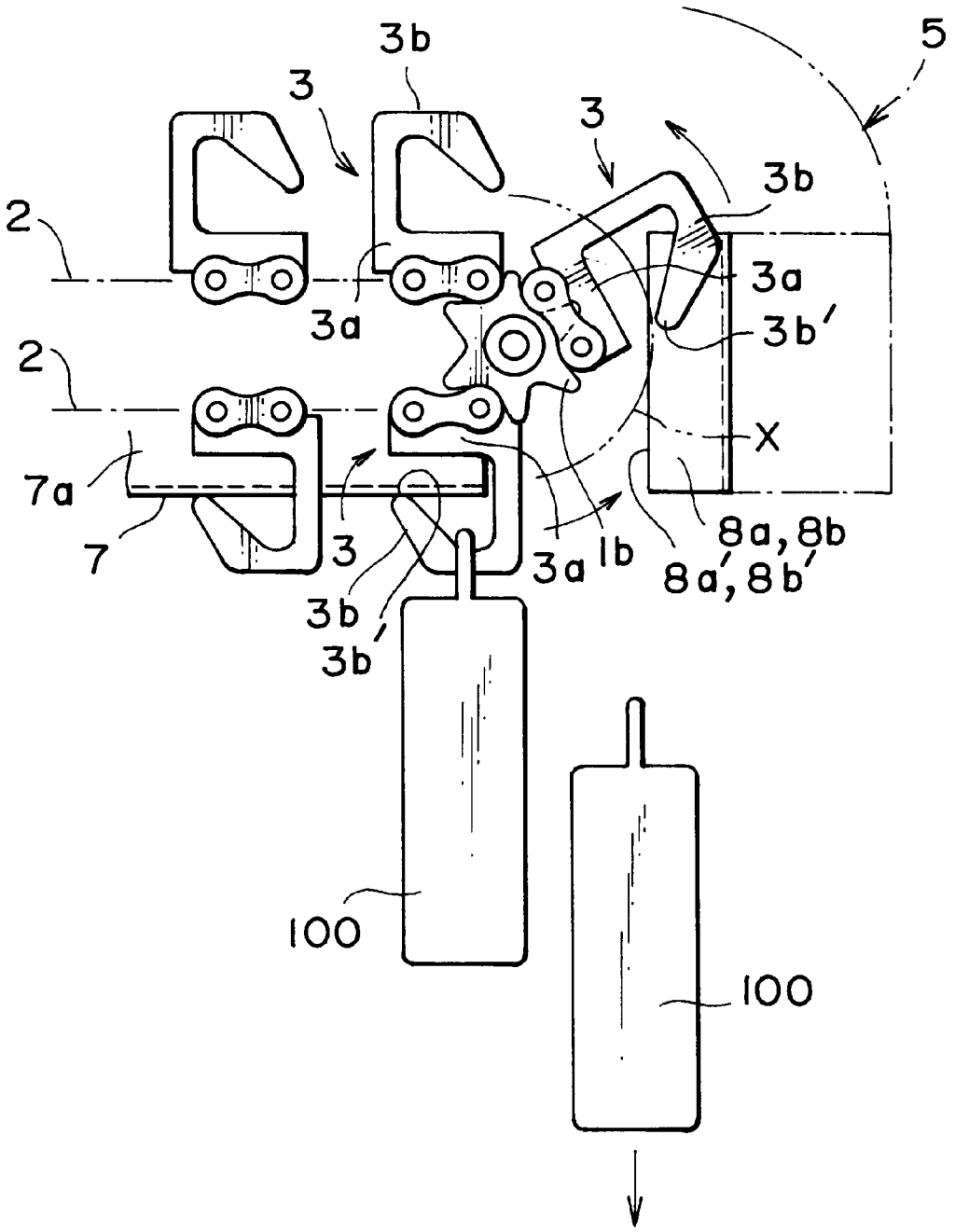
FIG. 6 is a view for describing an operation of the release promoting member.

Referring to FIGS. 5 and 6 together with FIGS. 1 and 2, the description will proceed. The commodity discharge apparatus further comprises, as a release promoting member, a pair of release promoting plates 8*a* and 8*b* having an L-shaped plan view and interposed between the front end of the casing 4 and the cover 5. The release promoting plates 8*a* and 8*b* have edge portions 8*a*' and 8*b*', respectively, extending in the vertical direction. Each of the release promoting plates 8*a* and 8*b* is referred to as a release promoting member.

Following the circulation of the endless chain 2, the commodity suspension hook 3 moves around the front sprocket 1*b* when it is transferred from the lower traveling portion to the upper traveling portion of the endless chain 2. During the movement of the commodity suspension hook 3 around the front sprocket 1*b*, the free end 3*b*' of the hook portion 3*b* of the commodity suspension hook 3 follows a locus X.

Each of the edge portions 8*a*' and 8*b*' is located in the vicinity of a farthest point on the locus X of the free end 3*b*' of the hook portion 3*b*. The farthest point is farthest from the front sprocket 1*b* in the horizontal direction among any other points on the locus X. The release promoting plates 8*a* and 8*b* are located on one lateral side and the other lateral side of the hook portion 3*b* of the commodity suspension hook 3 moving around the front sprocket 1*b*, respectively. Thus, the release promoting plates 8*a* and 8*b* are arranged so that the commodity suspension hook 3 moving around the front sprocket 1*b* is allowed to pass through without touching the release promoting plates 8*a* and 8*b*.

A plurality of commodity discharge apparatuses having the above-described structure are equipped in the vending machine (not shown) in a layered arrangement at a predetermined interval from each other in the vertical direction.

Each commodity discharge apparatus is supported by a suspending device (not shown) to be movable in the horizontal direction. If the commodity discharge apparatus at the operating position is pulled in the forward direction depicted by a white arrow in FIG. 1, the commodity discharge apparatus can be drawn out from the vending machine in the forward direction. Referring to FIG. 1, when the commodity discharge apparatus is located at the operating position, the rear end of the casing 4 of the commodity discharge apparatus is closely adjacent to a driving plate 9 attached to a casing (not shown) of the vending machine.

From the hook portions 3*b* of the commodity suspension hooks 3 of each commodity discharge apparatus, commodities or goods 100 are suspended. The commodities 100 may be different in kind in the respective commodity discharge apparatuses.

Next, the description will be made about the operation of the commodity discharge apparatus of FIGS. 1 through 6.

In order to buy a commodity, a purchaser or consumer throws the coin into a coin slot (not shown) of the vending machine and pushes a commodity selecting button (not shown). In this event, in the commodity discharge apparatus in which the desired commodities 100 are suspended, the motor with the encoder (not shown) is activated to rotate the rear sprocket 1*a* by a predetermined angle. The lower traveling portion of the endless chain 2 moves toward the front sprocket 1*b* over a predetermined distance. Following the movement of the lower traveling portion of the endless chain 2, the commodity suspension hooks 3 suspended from the lower traveling portion of the endless chain 2 move toward the front sprocket 1*b* by the predetermined distance. While the commodity suspension hooks 3 in the suspended position move toward the front sprocket 1*b*, the weights of the endless chain 2, the commodity suspension hooks 3, and the commodities 100 are supported by the bottom wall 4*a* of the casing 4.

Because the hook portions 3*b* of the commodity suspension hooks 3 are so sharply bent that the commodities 100 will not easily be released from the hook portions 3*b* of the commodity suspension hooks 3 even if the vending machine is rocked.

When the commodity discharge apparatus is put into operation, the fall preventing plate 7 is located at the operating position depicted by a solid line in each of FIGS. 1 and 2. As described above, the fall preventing plate 7 extends in parallel to the endless chain 2 on the lateral side of the hook portions 3*b* of the commodity suspension hooks 3 and at the level substantially equal to that of the free ends 3*b*' of the hook portions 3*b* of the commodity suspension hooks 3 in the suspended position. As is apparent from FIGS. 1 and 3, when the commodity suspension hooks 3 in the suspended position are seen from the lateral side, an opening of the hook portion 3*b* is closed by the fall preventing plate 7 mentioned above. With this structure, the commodities 100 will not easily be released from the hook portions 3*b* even if the vending machine is rocked. This is because an upper end of each commodity 100 is brought into contact with the fall preventing plate 7. Therefore, the commodity discharge apparatus is excellent in theftproofness.

In order to charge the commodities 100, i.e., in order to hook the commodities 100 on the commodity suspension hooks 3, the commodity discharge apparatus is pulled in the forward direction depicted by the white arrow in FIG. 1 to be drawn out from the vending machine. Then, the fall preventing plate 7 is pushed in the rearward direction to be moved to the retracted position depicted by a dot-dash line in each of FIGS. 1 and 2. At the retracted position, the fall preventing plate 7 extends in parallel to the endless chain 2 above the free ends 3*b*' of the hook portions 3*b*. Therefore, the commodities 100 can be easily hooked on the hook portions 3*b* of the commodity suspension hooks 3.

After the commodities 100 are charged, the fall preventing plate 7 is pulled forward to be moved to the operating position depicted by the solid line in each of FIGS. 1 and 2. Then, the commodity discharge apparatus is pushed rearward to be returned into the vending machine.

It is assumed here that an operator has failed to return the fall preventing plate 7 from the retracted position to the operating position. Even in this event, when the commodity discharge apparatus is pushed rearward to be returned into the vending machine, the rear end of the fall preventing plate 7 and a rear end of the fitting portion 7*a* are brought into contact with the driving plate 9 before the commodity discharge apparatus reaches the operating position, as seen from FIG. 1. Following the rearward movement of the commodity discharge apparatus, the fall preventing plate 7 is driven to move forward. As a result, the fall preventing plate 7 reaches the operating position at the time instant when the commodity discharge apparatus reaches the operating position. Thus, while the commodity discharge apparatus is in operation, the fall preventing plate 7 is always located at the operating position to prevent the commodity 100 from being released from the commodity suspension hook 3.

As shown in FIG. 6, the commodity suspension hook 3 in the suspended position is transferred around the front sprocket 1*b* from the lower traveling path to the upper traveling path. At this time, the free end 3*b*' of the hook portion 3*b* is faced downward. The commodity 100 is released and falls down from the hook portion 3*b* by its own weight with its free end 3*b*' faced downward.

While the commodity suspension hook 3 is moved around the front sprocket 1*b*, the commodity 100 hooked on the hook portion 3*b* is brought into contact with the edge portions 8*a*' and 8*b*' of the release promoting plates 8*a* and 8*b*. Each of the edge portions 8*a*' and 8*b*' extends in the vertical direction in the vicinity of the farthest point on the locus X of the free end 3*b*' of the hook portion 3*b* of the commodity suspension hook 3. Therefore, the commodity 100 brought into contact with the edge portions 8*a*' and 8*b*' is pushed by the edge portions 8*a*' and 8*b*' to move toward the free end 3*b*' of the hook portion 3*b* when the commodity suspension hook 3 is moved around the front sprocket 1*b* from the lower traveling path to the upper traveling path. This promotes the release of the commodity 100 from the hook portion 3*b*. Thus, it is assured that the commodity 100 is released from the commodity suspension hook 3 in the vicinity of the front sprocket 1*b* even if the hook 3*b* is so sharply bent.

After released, the commodity 100 collides with the curved top wall 5*a* of the cover 5 of another commodity discharge apparatus at a lower level and falls down along the top wall 5*a* toward the end of the cover 5 in the horizontal direction. Without contacting still another commodity discharge apparatus at a still lower level, the commodity 100 falls down into a commodity receiver (not shown) formed below the commodity discharge apparatuses. The purchaser opens a shutter (not shown) and takes out the commodity 100 in the commodity receiver.

After released from the engagement with the commodity 100, the commodity suspension hook 3 moves to the upper traveling path of the endless chain 2 following the movement of the endless chain 2. During traveling along the upper traveling path, the endless chain 2 and the commodity suspension hook 3 are supported by the guide rail 6 in the vertical direction.

While the present invention has thus far been described in connection with a single preferred embodiment thereof, it will readily be possible for those skilled in the art to put this invention into practice in various other manners. For example, an additional fall preventing plate may be attached to the other side wall of the casing. Either one of the release promoting plates may be omitted. The release promoting plates may be replaced by wire members such as piano wires or a rod-shaped member extending in the vertical direction at positions corresponding to the end portions.

What is claimed is:

1. A commodity discharge apparatus for a vending machine, comprising:

fist and second sprockets spaced from each other in a horizontal direction;

an endless chain engaged with said first and second sprockets and extending on a vertical plane to form an endless loop, said endless chain being adapted to circulate through said first and second sprockets and through a lower and an upper traveling path each extending between said first and second sprockets;

a hook unrotatably attached to a part of said endless chain for hooking a commodity only when said part is placed at said lower traveling path;

a fall preventing member extending parallel to said lower traveling path and beside said hook for preventing a fall of said commodity from said hook, said fall preventing member being movable between an operating position and a retracted position which is retracted over said operating position, said operating position having a level substantially equal to a level of a fee end of said hook; and a driving member connected to said fall preventing member for driving the movement of said fill preventing member from said operating position to said retracted position.

2. A commodity discharge apparatus as claimed in claim 1, wherein said endless chain includes:

a plurality of links; and a plurality of pins connecting said links to each other to form said endless loop, said hook being engaged with adjacent ones of said pins.

3. A commodity discharge apparatus as claimed in claim 1, wherein said hook is moved from said first sprocket towards said second sprocket when said part of said endless chain passes through said lower traveling path, said commodity discharge apparatus further comprising a release promoting member placed in a vicinity of said second sprocket for promoting a release of said commodity from said hook in cooperation with movement of said hook.

4. A commodity discharge apparatus as claimed in claim 3, wherein said release promoting member has an edge portion that engages said commodity to remove said commodity from said hook when said part of the endless chain passes through said second sprocket.

5. A commodity discharge apparatus as claimed in claim 4, wherein a free end of said hook is moved to have a locus when said part of the endless chain passes through said second sprocket, said edge portion extending in a vicinity of said locus.

6. A commodity discharge apparatus as claimed in claim 5, wherein said edge portion extends in a vertical direction in a vicinity of a farthest point on said locus, where said farthest point is farthest from said second sprocket in said horizontal direction among other points on said locus.

7. A commodity discharge apparatus for a vending machine, comprising:

first and second sprockets spaced from each other in a horizontal direction;

an endless chain engaged with said first and second sprockets and extending on a vertical plane to form an endless loop, said endless chain being adapted to circulate through said first and second sprockets and through a lower and an upper traveling path each extending between said first and second sprockets;

a hook unrotatably attached to a part of said endless chain for hooking a commodity only when said part is placed at said lower traveling path, said hook being moved from said first sprocket towards said second sprocket when said part of said endless chain passes through said lower traveling path;

a fall preventing member extending parallel to said lower traveling path. beside said hook for preventing a fall of said commodity from said hook; and a release promoting member placed in a vicinity of said second sprocket for promoting a release of said commodity from said hook in cooperation with movement of said hook, said release promoting member having an edge portion that extends in a substantially vertical direction and engages said commodity to remove said commodity from said hook.

8. A commodity discharge apparatus as claimed in claim 7, wherein said fall preventing member is placed at a level substantially equal to a level of a free end of said hook.

9. A commodity discharge apparatus as claimed in claim 7, wherein said endless chain includes:

a plurality of links; and a plurality of pins connecting said links to each other to form said endless loop, said hook being engaged with adjacent ones of said pins.

10. A commodity discharge apparatus as claimed in claim 7, wherein said fall preventing member is movable between an operating position and a retracted position which is retracted over said operation position, said operating position having a level substantially equal to a level of a free end of said hook.

11. A commodity discharge apparatus as claimed in claim 10, further comprising a driving member connected to said fall preventing member for driving the movement of said fall preventing member from said opening position to said retracted position.

12. A commodity discharge apparatus for a vending machine, comprising:

first and second sprockets spaced from each other in a horizontal direction;

an endless chain engaged with said first and second sprockets and extending on a vertical plane to form an endless loop, said endless chain being adapted to circulate through said first and second sprockets and through a lower and an upper traveling path each extending between said first and second sprockets;

a hook unrotatably attached to a part of said endless chain for hooking a commodity only when said part is placed at said lower traveling part, said hook being moved from said first sprocket towards said second sprocket when said part of said endless chain passes through said lower traveling path;

a fall preventing member extending parallel to said lower traveling path beside said hook for preventing a fall of said commodity from said hook; and a release promoting member placed in the vicinity of said second sprocket for promoting a release of said commodity from said hook in cooperation with movement of said hook, said release promoting member having an edge portion which is engaged with said commodity to remove said commodity from said hook when said part of the endless chain passes through said second sprocket, a free end of said hook being movable to define a locus when said part of the endless chain passes through said second sprocket, said edge portion extending in a vicinity of said locus, and said edge portion extending in a vertical direction in a vicinity of a farthest point on said locus, said farthest point being farthest from said second sprocket in said horizontal direction among other points on said locus.

13. A commodity discharge apparatus as claimed in claim 12, wherein said fall preventing member is placed at a level substantially equal to a level of a free end of said hook.

14. A commodity discharge apparatus as claimed in claim 12, wherein said endless chain comprises:

a plurality of links; and a plurality of pins connecting said links to each other to form said endless loop, said hook being engaged with adjacent ones of said pins.

15. A commodity discharge apparatus as claimed in claim 12, wherein said fall preventing member is movable between an operating position and a retracted position which is retracted over said operation position, said operating position having a level substantially equal to that of a free end of said hook.

16. A commodity discharge apparatus as claimed in claim 15, further comprising a driving member connected to said fall preventing member for driving the movement of said fall preventing member from said operating position to said retracted position.

* * * * *

UNITED STATES PATENT AND TRADEMARK OFFICE

CERTIFICATE OF CORRECTION

PATENT NO. : 6,439,423 B1
DATED : August 27, 2002
INVENTOR(S) : Kazuhiko Suzuki

It is certified that error appears in the above-identified patent and that said Letters Patent is hereby corrected as shown below:

Column 7,
Line 23, change “fill” to -- fall --.

Column 8,
Line 7, delete the period after the word “path”.

Signed and Sealed this

Thirtieth Day of December, 2003

JAMES E. ROGAN
*Director of the United States Patent and Trademark Office*